United States Patent [19]

Olofsson

[11] 3,947,163

[45] Mar. 30, 1976

[54] SCREW ROTOR MACHINE WITH AXIALLY BALANCED HOLLOW THREAD ROTOR

[75] Inventor: Hans Kristoffer Olofsson, Huddinge, Sweden

[73] Assignee: Atlas Copco Aktiebolag, Huddinge, Sweden

[22] Filed: July 18, 1974

[21] Appl. No.: 489,942

[30] Foreign Application Priority Data

July 20, 1973 Sweden ..... 7310170

[52] U.S. Cl. ..... 418/203; 418/164

[51] Int. Cl.[2] ..... F01C 1/16; F04C 17/12

[58] Field of Search ..... 418/9, 48, 55, 151, 164, 418/166, 201, 203, 220

[56] References Cited

UNITED STATES PATENTS 2,527,536 10/1950 Engberg ..... 418/166

2,590,560 3/1952 Montelius ..... 418/203

FOREIGN PATENTS OR APPLICATIONS 427,475 4/1935 United Kingdom ..... 418/48

1,346,417 11/1963 France ..... 418/48

*Primary Examiner*—John J. Vrablik

*Attorney, Agent, or Firm*—Eric Y. Munson

[57] ABSTRACT

A screw rotor machine is disclosed in which a screw thread rotor enclosing a screw cam rotor is axially balanced through having an area enclosed by a seal between the screw thread rotor and the housing which area stands in a predetermined relation to the hole area of the screw thread rotor.

6 Claims, 3 Drawing Figures

SCREW ROTOR MACHINE WITH AXIALLY BALANCED HOLLOW THREAD ROTOR

BACKGROUND OF THE INVENTION

The invention relates to a screw rotor machine for a compressible working medium with a screw cam rotor and a screw thread rotor enclosing the screw cam rotor which rotors are rotatably journalled in a housing for rotation around mutually sideways displaced fixed rotation axes and thereby between their screw cam means and screw thread means form chambers for the working medium which chambers during rotation of the rotors move from end to end of the rotors while changing their volumes.

In such screw rotor machines of which suggestions are shown e.g. in Swedish Pat. No. 85.331 and U.S. Pat. No. 1.892.217 practical operation at high numbers of revolution and pressure suitable for now actual compressor or motor applications has hitherto not been realized. According to prior suggestions the bearings of the screw thread rotor are exposed to the entire axial load which follows from the pressure of the working medium against the end of the screw thread rotor. The design suggestions are, therefore, only suitable for low pressures and numbers of revolution which result in a low compressor capacity or motor power.

SUMMARY OF THE INVENTION

The invention has as its purpose to create a screw rotor machine of the above mentioned type in which the axial load on the bearings of the screw thread rotor running at a high number of revolutions and a high pressure level easily and effectively are brought down. This is achieved through the characteristics given in the claims.

BRIEF DESCRIPTION OF THE DRAWINGS

The invention is described more in detail in connection with the accompanying drawings in which.

DETAILED DESCRIPTION OF THE PREFERRED EMBODIMENTS

Figure 1:
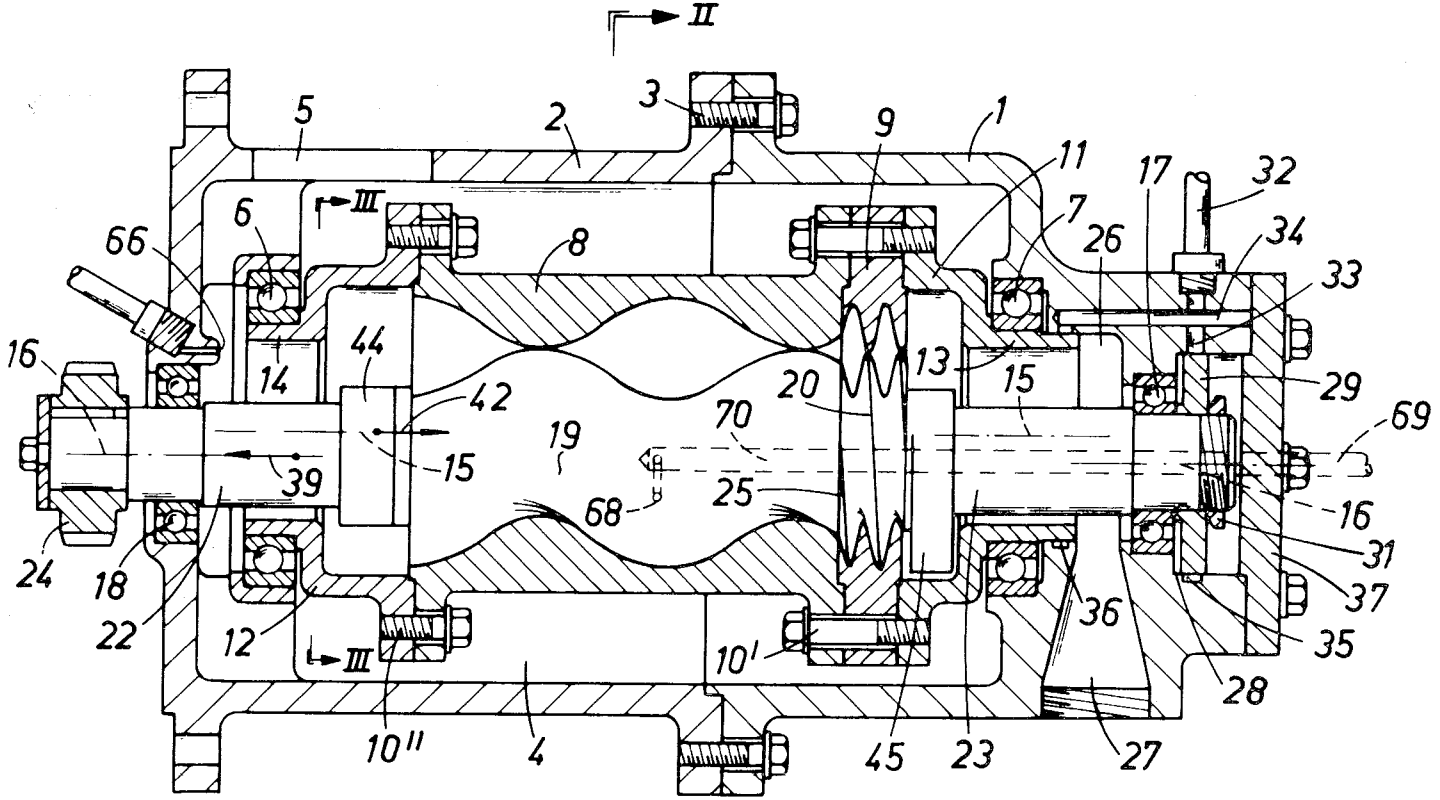
FIG. 1 shows a longitudinal section through a screw rotor machine according to the invention.
Figure 2:
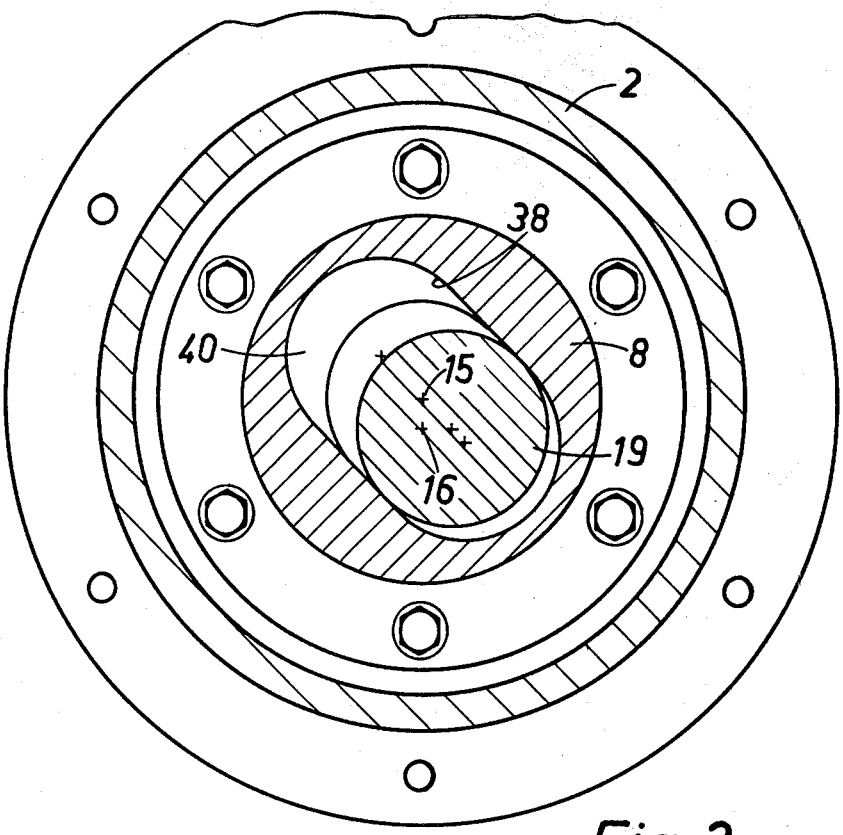
FIG. 2 is a cross section according to line II—II in FIG. 1.
Figure 3:
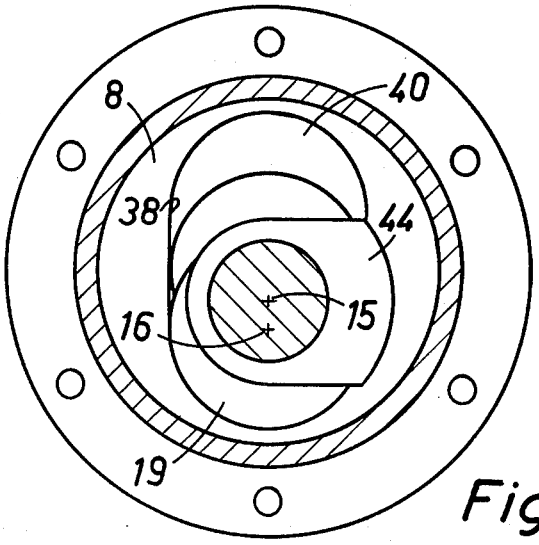
FIG. 3 is a cross section according to line III—III in FIG. 1.

In FIGS. 1–3 the invention is shown as applied to a screw compressor but the illustrated constructive solution is also applicable to other types of screw rotor machines e.g. screw motors or screw pumps. The screw compressor shown has a housing 1, 2 which forms part of a not shown and as regards other components in a conventional way built up compressor aggregate. The housing comprises two transversely divided housing parts 1 and 2 which are kept together by means of screws 3 and enclose a chamber 4 for the compressible working medium e.g. air. The air enters into the housing part 2 via an inlet opening 5 after it has passed a not shown filter. The housing parts 1, 2 carry in the chamber 4 coaxially arranged rolling bearings 6, 7. A gate or screw thread rotor provided with screw threads is divided transversely and comprises two hollow rotor parts 8, 9 which are mutually fixed by screws 10¹ and at the ends fastened to end parts 11, 12. The end part 11 is fixed by the screws 10¹ and has a tubular neck of shaft 13 with a reduced diameter which is carried by the rolling bearing 7. The end part 12 is fixed by screws 10¹¹ to the rotor part 8 and has a similarly reduced neck of shaft 14 which is carried by the rolling bearing 6. The screw thread rotor 8, 9 is through this arrangement rotatably journalled in the chamber 4 for rotation around a fix rotation axis 15.

Rolling bearings 17, 18 are arranged in the respective housing parts 1, 2 and carry rotatably a screw cam rotor 19, 20 which through gudgeons 22, 23 is introduced into the rolling bearings 17, 18 and rotates around a fix rotation axis 16 which is situated eccentrically to and parallelly to the rotation axis 15. The screw cam rotor 19, 20 can if needed be dynamically balanced by means of eccentric weights 44, 45 which are freely rotatable in hollow spaces inside the end parts 11, 12 of the screw thread rotor 8, 9. The screw cam rotor 19, 20 is driven by an external not shown motor and gear change over a toothed wheel 24 which outside the housing part 2 is keyed to the gudgeon 22.

Screw cam means on the screw cam rotor 19, 20 is during rotation in engagement with screw thread means in the screw thread rotor 8, 9 so that the latter is rotated around the axis 15 with a gear change depending on the type of the screw engagement. From the chamber 4 the working medium flows via the neck of shaft 14 and the end part 12 into the screw thread means of the screw thread rotor 8, 9. The screw cam means of the screw cam rotor 19, 20 cooperates with the screw thread means so that chambers for the working medium are formed during rotation which chambers move from end to end of the rotors while changing their volumes i.e. in the shown compressor application the working medium is compressed during passage through the rotor parts 8 and 9. The cooperating screw profiles can thereby be made in an arbitrary suitable way. The embodiment shows in FIGS. 2, 3 the screw cam part 19 made as a single-thread screw with a circular profile and constant lead. The screw thread rotor part 8 hereby becomes a hollow profile with two opposite half circular and mutually connected screw threads which sealingly cooperate with the screw profile and having a constant lead which is double that of the screw cam rotor part 19. In a leap plane 25 which is transverse to the rotors and forming a dividing plane between the screw thread rotor parts 8 and 9 and a transference plane between the screw cam rotor parts 19 and 20, a sudden decrease of the thread leads from the leads in the rotor parts 8 and 19 to the leads in the rotor parts 20 and 9 occurs. Through this the rotor parts 9, 20 will act as gates damming the working medium axially which during rotation makes inner compression of the working medium between the rotor parts 8 and 19 possible. The compressed working medium is passed through the rotor parts 9, 20 into the end part 11 and continues via the neck of shaft 13 to a pressure chamber 26 in the housing part 1 from which it is taken off under pressure via a high pressure outlet 27.

The pressure chamber 26 is via the rolling bearing 17 open to a cylindrical guidance 28 which is coaxial with the rotation axis 16 and rotatably carries a balancing part in form of a piston 29. The piston 29 is by means of a nut 31 together with the inner race of the rolling bearing 17 fastened to the gudgeon 23. Oil under pressure is supplied from a suitable not shown pressure source in the compressor aggregate via a conduit 32 to channels 33, 34 in the housing part 1 of which the channel 33 emerges into a circumferential groove 35 around the piston 29 while the channel 34 emerges into a corresponding circumferential groove 36 around the neck of shaft 13 and coaxial with the rotation axis 15. The circumferential grooves 35, 36 form liquid pressure seals through which the pressure chamber 26 is sealed off in relation to the rotating rotor parts. The guidance 28 is covered by a cover 37 and provided with suitable drainage outside the piston 29.

The balancing piston 29 is exposed to the pressure of the working medium in the pressure chamber 26 and given such an area in relation to the hole area 40 of the screw thread rotor which is enclosed by the circumscribing contour line 38 in FIGS. 2, 3 that the desired limitation of the axial force loading of the screw cam rotor 19, 20 and its bearing 17 is obtained. In the present embodiment the diameter of the balancing piston 29 is chosen somewhat smaller than the diameter of the circle corresponding to the hole area 40 of the screw thread rotor 8, 9. With superatmospheric pressure in the pressure chamber 26 this results in a constantly in the illustrated arrow direction 39, FIG. 1, acting restricted force component on the rolling bearing 17. The neck of shaft 13 of the screw thread rotor 8, 9 has the sealing off comprising the circumferential groove 36 suitably situated at a diameter which also is somewhat smaller than the diameter of the circle corresponding to the hole area 40 of the screw thread rotor. Consequently superatmospheric pressure in the pressure chamber 26 will result therein that the rolling bearing 7 of the screw thread rotor 8, 9 is exposed to an axial force which constantly acts in the direction of the arrow 42. Through exact mounting of the rolling bearings the play between the rotors during operation is hereby kept very low. If needed it is possible to allow the outer races of the rolling bearings 6, 7 to be freely glidable and axially unlocked by stops in the housing parts 1, 2 so that the screw thread rotor 8, 9 may adjust itself in relation to the flanks of the screw cam means on the screw cam rotor 19, 20 and the leap plane 25 of the rotors. Since the area of the balancing piston 29 and the area of the neck of shaft 13 situated inside the circumferential groove 36 both are close to the hole area 40 the axial forces in the arrow directions 39 and 42 become low so that the screw cam rotor 19, 20 can be driven with high numbers of revolution without overloading the rolling bearings. Of these the bearings 17, 18 in the present compressor application work with a number of revolutions on the screw cam rotor 19, 20 amounting to 15.000 rpm while the screw thread 8, 9 in its bearings 6, 7 runs with half that number of revolutions.

In order to improve the driving engagement between the screw cam rotor 19, 20 and the screw thread rotor 8, 9 while simultaneously improving the sealing between the rotors and the cooling of the working medium during compression, it is suitable to inject liquid into the working medium between the rotors preferably oil in finely divided form. The oil can be injected into the neck of shaft 14 via a nozzle 66 carried by the housing part 2 or alternatively via one or more radial borings 68 in the screw cam rotor part 19 which are supplied with oil via an oil channel 69 through the cover 37 and a central axial rotor boring 70 connected to the oil channel 69 through the rotor part 23, 20, 19.

In simple pump applications the rotor parts 9, 20 making inner compression possible can be excluded.

What I claim is:

1. In a screw rotor machine for a compressible working medium including a screw cam rotor, a screw thread rotor enclosing the screw cam rotor, the screw cam rotor and screw thread rotor being rotatably journalled in a housing for respective rotation around parallel mutually displaced rotation axes, the rotors forming chambers for the working medium between their screw cam and screw threads which chambers move from end to end of the rotors during their rotation while changing their volume, the improvement enabling machine operation at a high number of revolutions and a high pressure level with a reduced axial load on the bearings of the screw thread rotor comprising:

a high pressure chamber formed in the housing adjacent the high pressure discharge ends of the rotors, a circular balancing piston secured to the screw cam rotor and exposed to the high pressure in the chamber, a stepped end part fixed to the screw thread rotor and having a tubular neck of reduced diameter, the tubular neck forming a shaft projecting into the high pressure chamber and being sealed off from the housing, the diameter of the balancing piston and of the tubular neck shaft where it is sealed being smaller than the diameter of a circle corresponding to the opening area of the screw thread rotor, whereby the high pressure in the chamber acting on the balancing piston and on the end part will result in low axial forces on the rotors in opposite directions serving to substantially balance the axial load while maintaining play between the rotors at a minimum.

2. The improved screw rotor machine according to claim 1, wherein the area enclosed by the seal is approximately equal to the screw thread rotor opening area.

3. The improved screw rotor machine according to claim 1, wherein the screw thread rotor at its ends is provided with coaxial end parts provided with necks of shaft through which the screw thread rotor is carried in the housing by means of rolling bearings whereby one of the necks of shaft forms a low pressure opening and the other a high pressure opening for the screw thread rotor each being eccentric in relation to the rotation axis of the screw cam rotor.

4. The improved screw rotor machine according to claim 1, wherein the screw thread rotor is rotatably journalled in and enclosed by a chamber for the working medium which communicates with the low pressure opening of the screw thread rotor and an outer low pressure opening for the working medium is arranged in the housing communicates with the chamber.

5. The improved screw rotor machine according to claim 1, wherein the screw cam rotor is journalled in the housing by means of rolling bearings axially outside the low pressure and high pressure openings.

6. The improved screw rotor machine according to claim 5, wherein a high pressure outlet for the working medium is connected to the pressure chamber and arranged in the housing between the bearings for the high pressure ends of the rotors.

* * * * *